US010588373B2

(12) United States Patent
Staudinger

(10) Patent No.: US 10,588,373 B2
(45) Date of Patent: Mar. 17, 2020

(54) PROTECTIVE HELMET

(71) Applicant: Rosenbauer International AG, Leonding (AT)

(72) Inventor: Peter Staudinger, Schlatt (AT)

(73) Assignee: Rosenbauer International AG, Leonding (AT)

( * ) Notice: Subject to any disclaimer, the term of this patent is extended or adjusted under 35 U.S.C. 154(b) by 404 days.

(21) Appl. No.: 15/501,277

(22) PCT Filed: Aug. 5, 2015

(86) PCT No.: PCT/AT2015/050191
§ 371 (c)(1),
(2) Date: Mar. 17, 2017

(87) PCT Pub. No.: WO2016/019406
PCT Pub. Date: Feb. 11, 2016

(65) Prior Publication Data

US 2017/0251746 A1 Sep. 7, 2017

(30) Foreign Application Priority Data

Aug. 6, 2014 (AT) ..... A 50551/2014

(51) Int. Cl.
*A42B 3/14* (2006.01)
*A42B 3/08* (2006.01)
*A42B 3/22* (2006.01)

(52) U.S. Cl.
CPC ..... *A42B 3/145* (2013.01); *A42B 3/08* (2013.01); *A42B 3/222* (2013.01)

(58) Field of Classification Search
CPC ..... A42B 3/08; A42B 3/145; A42B 3/222
(Continued)

(56) References Cited

U.S. PATENT DOCUMENTS 3,619,814 A 11/1971 Aileo
4,000,520 A 1/1977 Svendsen et al.
(Continued)

FOREIGN PATENT DOCUMENTS

CN 2299484 Y 12/1998
CN 2459926 Y 11/2001
(Continued)

OTHER PUBLICATIONS

International Search Report of PCT/AT2015/050191, dated Feb. 1, 2016.

*Primary Examiner* — Anne M Kozak
(74) *Attorney, Agent, or Firm* — Collard & Roe, P.C.

(57) ABSTRACT

A protective helmet for the head of a human being includes an outer protective shell and an inner support structure that includes a headband defining a head-accommodating opening as well as a upper head support; on the headband, the support structure has a forehead-accommodating side and a side accommodating the back of the head; the support structure is secured to the protective shell using at least one force-transmitting connector. A longitudinal adjuster which is arranged between the protective shell and the support structure allows the protective shell to be adjusted relative to the support structure in the direction of the forehead-accommodating side or in the direction of the side accommodating the back of the head.

20 Claims, 8 Drawing Sheets

(58) Field of Classification Search
USPC ..... 2/416
See application file for complete search history.

(56) References Cited

U.S. PATENT DOCUMENTS

| | | | | |
|---|---|---|---|---|
| 4,293,960 | A * | 10/1981 | Palmaer | A42B 3/14 2/416 |
| 4,888,831 | A | 12/1989 | Priser | |
| 5,581,816 | A * | 12/1996 | Davis | A42B 3/0473 2/410 |
| 5,584,073 | A | 12/1996 | Radzelovage et al. | |
| 6,367,085 | B1 * | 4/2002 | Berg | A42B 3/145 128/201.24 |
| 7,120,939 | B1 * | 10/2006 | Howard | A42B 3/14 2/416 |
| 8,387,162 | B2 | 3/2013 | Huh | |
| 8,875,318 | B2 | 11/2014 | Huh | |
| 9,125,448 | B2 * | 9/2015 | Klotz | A42B 3/225 |
| 9,179,729 | B2 | 11/2015 | Cotterman et al. | |
| 2007/0245467 | A1 | 10/2007 | Lilenthal et al. | |
| 2011/0047679 | A1 | 3/2011 | Rogers et al. | |
| 2013/0205477 | A1 * | 8/2013 | Pfanner | A42B 3/166 2/416 |
| 2014/0101828 | A1 * | 4/2014 | Sugerman | A42B 3/145 2/411 |

FOREIGN PATENT DOCUMENTS

| | | | |
|---|---|---|---|
| DE | 2 061 087 | A | 6/1971 |
| DE | 10 2013 004 387 | A1 | 10/2013 |
| EP | 2 462 825 | A2 | 6/2012 |
| EP | 2 462 826 | A2 | 6/2012 |
| GB | 2 299 744 | A | 10/1996 |

* cited by examiner

PROTECTIVE HELMET

CROSS REFERENCE TO RELATED APPLICATIONS

This application is the National Stage of PCT/AT2015/050191 filed on Aug. 5, 2015, which claims priority under 35 U.S.C. § 119 of Austrian Application No. A 50551/2014 filed on Aug. 6, 2014, the disclosure of which is incorporated by reference. The international application under PCT article 21(2) was not published in English.

BACKGROUND OF THE INVENTION

Field of the Invention

The invention relates to a protective helmet for the head of a human being.

Description of the Related Art

From U.S. Pat. No. 4,888,831 A a generic protective helmet is known, which comprises a hard helmet shell and an internal structure connected to the helmet shell. The internal structure comprises a forehead strip, which can be adjusted in width by a rotary knob. The forehead strip is connected by six suspension points to flexible support straps so that the head can be supported in said internal structure. The internal structure can be connected to holding attachments arranged in a fixed position on the helmet shell by securing tabs attached laterally to the forehead strip.

The design described in U.S. Pat. No. 4,888,831 A has the disadvantage that the protective helmet can only be adjusted to the various head sizes of different users in certain circumstances, and that the wearing comfort of the protective helmet is reduced by adjusting to a different head size.

From GB 2 299 744 A a further generic protective helmet is known. The protective helmet comprises an outer helmet formed by a helmet shell and an inner structure or inner arrangement receiving the head. The inner structure or inner arrangement comprises in turn an external support frame designed to run around the circumference of the head and a head band arranged inside the latter. The head band is arranged to be spaced apart from the support frame in radial direction and can be connected adjustably to the support frame by means of a four strap elements arranged distributed around the circumference. For changing the position of the head band relative to the support frame the individual band elements can be connected to the support frame in different positions from one another. Thus the position of the center of gravity of the helmet shell can be displaced relative to the inner structure or the inner arrangement.

US 2001/047679 A1 described a further embodiment of a protective helmet, which comprises a helmet shell formed by a front and a rear helmet shell part and an inner structure connected to the helmet shell. The inner structure is held adjustably together with one of the two helmet shell parts in its relative position relative to the other helmet shell part on the latter. In this way here also the position of the center of gravity of the helmet shell can be moved relative to the inner structure or the inner arrangement.

EP 2 462 826 A2 describes a joint coupling arrangement for a welding mask, a face shield or a protective helmet with a head band. By means of the joint coupling arrangement the welding mask, the face shield or the protective helmet is held adjustably in its position relative to the head band located on the user's head. In this way the position can be adjusted relative to the user's head from a position closer to the user into a position further away from the user.

From US 2007/245467 A1 a further embodiment of a head protection is known, comprising a protective visor, a connecting arrangement and a head band. The protective visor can be adjusted by means of the connecting arrangement in its relative position relative to the head band and thus relative to the head of the user from a position closer to the user into a position further removed from the user.

SUMMARY OF THE INVENTION

The underlying objective of the present invention is to create an improved protective helmet, which can be adjusted easily to the various head sizes of different users and thereby provides a good level of wearing comfort.

The objective is achieved by the features according to the invention.

According to the invention a protective helmet is designed for the head of a human being, which comprises an external protective shell and an internal support structure. The support structure comprises a headband defining a head receiving opening and an upper head support. Furthermore, the support structure has on the headband a forehead accommodating side and a rear head accommodating side, wherein the support structure is secured to the protective shell by means of at least one force-transmitting connector. Between the protective shell and the support structure a longitudinal adjuster is arranged, by means of which longitudinal adjuster the protective shell can be adjusted relative to the support structure in the direction of the end face or in the direction of the rear head accommodating side. The longitudinal adjuster 19 comprises a support strap, which support strap extends from both temples over the forehead accommodating side and the support strap is connected to the protective shell in the region of the temples respectively by a form-fitting and/or force-fitting connecting arrangement. The support strap comprises at least one first coupler, which interacts with at least one second coupler on the support structure.

An advantage of the design according to the invention is that by means of the adjustability of the protective shell relative to the support structure the center of gravity of the protective helmet can be varied. In this way the protective helmet can be adjusted to the requirements of a large number of users, so that the protective helmet fits as comfortably as possible on the head of the user. This is particularly important for protective helmets which are worn either in difficult environmental conditions or over a longer time period, as is the case with emergency services such as the fire department, rescue services, disaster relief services etc. Furthermore, by means of the longitudinal adjuster and the possibility associated therewith of adjusting the center of gravity of the protective helmet, it is possible to obtain a protective helmet, which is equipped with various different attachments such as a light, infrared camera, visor, protection for the nape of the neck etc., which can be adjusted such that the center of gravity of the pro-protective helmet bears centrally or according to the wishes of the user on the head of the user. In this way it is possible to ensure that the user can concentrate in an individual case on his/her allotted task, so that the quality of the user's work is not impaired as far as possible. The protective helmet according to the invention in addition to being used by emergency services and also by other professions, such as in the forestry sector, on building sites, in industry, in alpine areas etc., has the advantage that it provides the greatest possible degree of wearing comfort and thus interferes as little as possible with the user. Furthermore, it is an advantage in this case that by using such a support strap the protective shell can be secured to the support structure, and thus the support structure can be displaced relative to the protective shell. Furthermore, the support structure can be supported in a stable manner in terms of its form in the support strap, so that the protective helmet has a good fit and can be fixed onto the head of the user so that it does not slide as far as possible. As the support structure and the support strap are connected to one another by couplers, the support structure can be removed easily from the protective helmet so that the helmet shell of the protective helmet can be cleaned easily.

Furthermore, it is also possible that on the support strap in the region of the forehead accommodating side two first couplers are arranged to be symmetrical to a helmet central plane and interact with two second couplers, which are arranged on the support structure, in particular on the outside of the headband. It is an advantage in this case that by using couplers arranged to be symmetrical relative to the helmet central plane, a force possibly acting on the protective shell can be transmitted symmetrically to the support structure and thus to the head. In this way a force possibly acting on the protective shell can be diverted as gently as possible for the user.

Furthermore, it is possible that the support strap comprises in the area of the temples respectively at least one, first protrusion aligned to be essentially parallel to an upper head support plane and projecting in the direction of the protective shell, which protrusion engages in a groove arranged in the protective shell, whereby the support strap is mounted to be longitudinally displaceable relative to the protective shell. It is an advantage in this case that by means of such a groove connection a longitudinal guide can be formed, by means of which the protective shell can be displaced easily relative to the support strap and thus to the support structure. Furthermore, by means of such a protrusion interacting with a groove, it is possible that in addition to forces acting normally on the protrusion torques acting on the protrusion can also be transmitted between the support strap and protective shell. In this way the protective helmet is given additional stability, whereby forces acting on the protective helmet can be easily absorbed and damage to the protective helmet is avoided and thus the level of personal safety is increased.

According to one development it is possible that the support strap comprises in the region of the temples respectively at least one second protrusion arranged at an angle to the first protrusion and projecting in the direction of the protective shell, which protrusion engages optionally in one of several recesses arranged on the protective shell. It is an advantage that by means of this additional measure the connection can be improved further between the longitudinally displaceable support strap and protective shell so that an increased torque or increased forces can be transmitted by the protective helmet.

An embodiment is also advantageous according to which the support strap in the region of both temples has at least one opening and a receiving opening is arranged in the protective shell, wherein a fastening element, in particular a screw, passes through the opening and is accommodated in the receiving opening. In this way the connection between the longitudinally displaceable support strap and protective shell can be improved further so that an increased torque or increased forces can be transmitted by the protective helmet. Furthermore, in this way the connection between the support strap and helmet shell can be fixed in a position selected by the user.

Furthermore, it can be advantageous that the support strap comprises in the region of both temples respectively at least a first accommodating mount for securing a chin strap. It is an advantage in this case that the chin strap is displaced in this way by the support device, when the latter is displaced relative to the protective shell. In this way it is possible for the chin strap to be positioned as well as possible relative to the support device and thus relative to the head of the user, so that the protective helmet can be fixed easily onto the head of the user without the user being affected.

Furthermore, it is possible that the support strap comprises in the region of the two temples respectively at least one second fastening mount for a pivotable protective visor. It is an advantage in this case that the protective visor is moved with the support device, if the latter is adjusted relative to the protective shell. In this way it is possible that the protective visor can be positioned as well as possible relative the support device and thus relative to the user's head, so that the protective effect of the protective visor is as great as possible.

According to one development or according to an independent and separate concept of the invention it is possible to arrange at least two adjusting straps running from the read head accommodating side in the direction of the forehead on the upper head support of the support structure symmetrically relative to the helmet central plane, which adjusting straps are connected by a form-fitting longitudinally adjustable connection in a longitudinally displaceable manner to an accommodating mesh arranged on the forehead accommodating side. It is an advantage in this case that by means of said adjusting straps the position of the headband can be adjusted according to be specific requirements of the user to various different head heights. Thus it is possible to further increase the adjustability of the protective helmet to the specific head geometry of different users, whereby the wearing comfort can be increased. Said head height adjustment can be advantageous as mostly the head height adjustment involves a displacement of the center of gravity of the helmet, which can be balanced out by the longitudinal adjuster.

Furthermore, it is possible that the headband of the support structure can be designed to be adjustable in circumference on the rear head accommodating side by means of a width adjuster, whereby the head accommodating opening can be varied in size. It is an advantage here that the protective helmet can be adjusted as variably as possible to different users. If by means of the width adjuster the size of the head accommodating opening is adjusted, it may be that the center of gravity of the protective helmet shifts. This can be balanced out if necessary by the longitudinal adjuster. Thus a combination of the width adjuster and longitudinal adjuster can contribute to the fact that the protective helmet can be adjusted as well as possible to the requirements of a user, whereby the wearing comfort can be increased.

According to particular embodiment it is possible that the width adjuster can comprise a gear wheel, which engages in two overlapping end sections of the headband, wherein the gear wheel can optionally be articulated by a gear with a drive shaft, on which drive shaft an ad-adjusting wheel engages, wherein the drive shaft can have a polygonal cross-section, so that the adjusting wheel can be displaced relative to the drive shaft in the direction of a longitudinal axis of the drive shaft. It is an advantage in this case that in this way regardless of the current position of the support structure relative to the protective shell, the width adjuster remains adjustable so that the fit of the support structure can be adjusted as well as possible in order to obtain a comfortable fit of the protective helmet.

According to one advantageous development it is possible that the circumferential headband comprises in addition to the width adjuster at least one rough adjuster, preferably two rough adjusters, which is or are arranged respectively in the region of the temples of the headband. It is an advantage in this case that by means of such a rough adjuster the size of the head accommodating opening can be additionally adjusted. In this way the adjustability of the protective helmet can be increased further. The rough adjuster additionally has all of the additional advantages which have already been mentioned for the width adjuster.

In particular, it can be an advantage if the headband in the region of the at least one rough adjuster comprises a first and a second headband area, which face one another and are connected to one another by a form-fitting locking element. It is an advantage in this case that the rough adjuster can have a simple structure, whereby the operator friendliness can be increased.

Furthermore, it can be advantageous, if in the first headband area an opening is formed and in the second headband area a tapering is provided, wherein the tapering of the second headband area is guided into the opening of the first headband area, wherein optionally recesses are provided in the first headband area and/or in the second headband area, which cooperate with projections in the respective other headband area, whereby the form-fitting connection can be produced. It is an advantage here that in this way the rough adjuster has a simple structure, whereby the operator friendliness can be increased.

Furthermore, it is also the case that the headband is connected to the protective shell on the rear head accommodating side at least by means of an intermediate piece. It is an advantage in this case that in this way the support structure is connected effectively to the protective shell, so that a possible force acting on the protective shell can be transmitted to the support struc-structure. By using an intermediate piece it is possible that the protective shell can be displaced relative to the support structure, without the support structure being deformed thereby. The intermediate piece is provided in order to balance out a change in the distance between the support structure and protective shell.

Furthermore, it is also possible that the intermediate piece is shaped as a strap-like component, which is folded back approximately in the center relative to a longitudinal extension by about 180°, so that a first coupling section and a second coupling section of the strap-like component are aligned to be approximately parallel with one another, wherein the first coupling section is connected to the headband and wherein the second coupling section is connected to the protective shell. It is an advantage in this case that the intermediate piece can be very flexible due to this shaping. In this way impact on the helmet shell can be damped by the intermediate piece, whereby the load on the head of the user can be reduced.

Furthermore, it can be an advantage that the form-fitting longitudinally adjustable connection is designed such that a projection is formed on the accommodating mesh, which projection engages optionally in one of several recesses arranged on the adjusting straps. It is an advantage in this case that the adjustability of the head height can be easily converted and also on implementation a rapid and simple adjustment can be made to the head height.

Furthermore, it is possible that the accommodating mesh comprises strap sections aligned in longitudinal direction and strap sections aligned in transverse direction, which form a net-like structure. It is an advantage in this case that by means of this net-like structure the load of the protective helmet can be transferred evenly to the head of the user. In this way the wearing comfort can be increased.

Lastly, it is possible that on the accommodating mesh at least one holding-down element is formed, by means of which at least one of the adjusting straps is guided. It is an advantage in this case that in this way the correct fit of the adjusting straps on the accommodating mesh can be achieved. In this way the personal safety is increased, as the risk of incorrectly positioning the adjusting strap is minimized.

BRIEF DESCRIPTION OF THE DRAWINGS

For a better understanding of the invention the latter is explained in more detail with reference to the following Figures.

In a much simplified, schematic view.

DETAILED DESCRIPTION OF PREFERRED EMBODIMENTS

Figure 1:
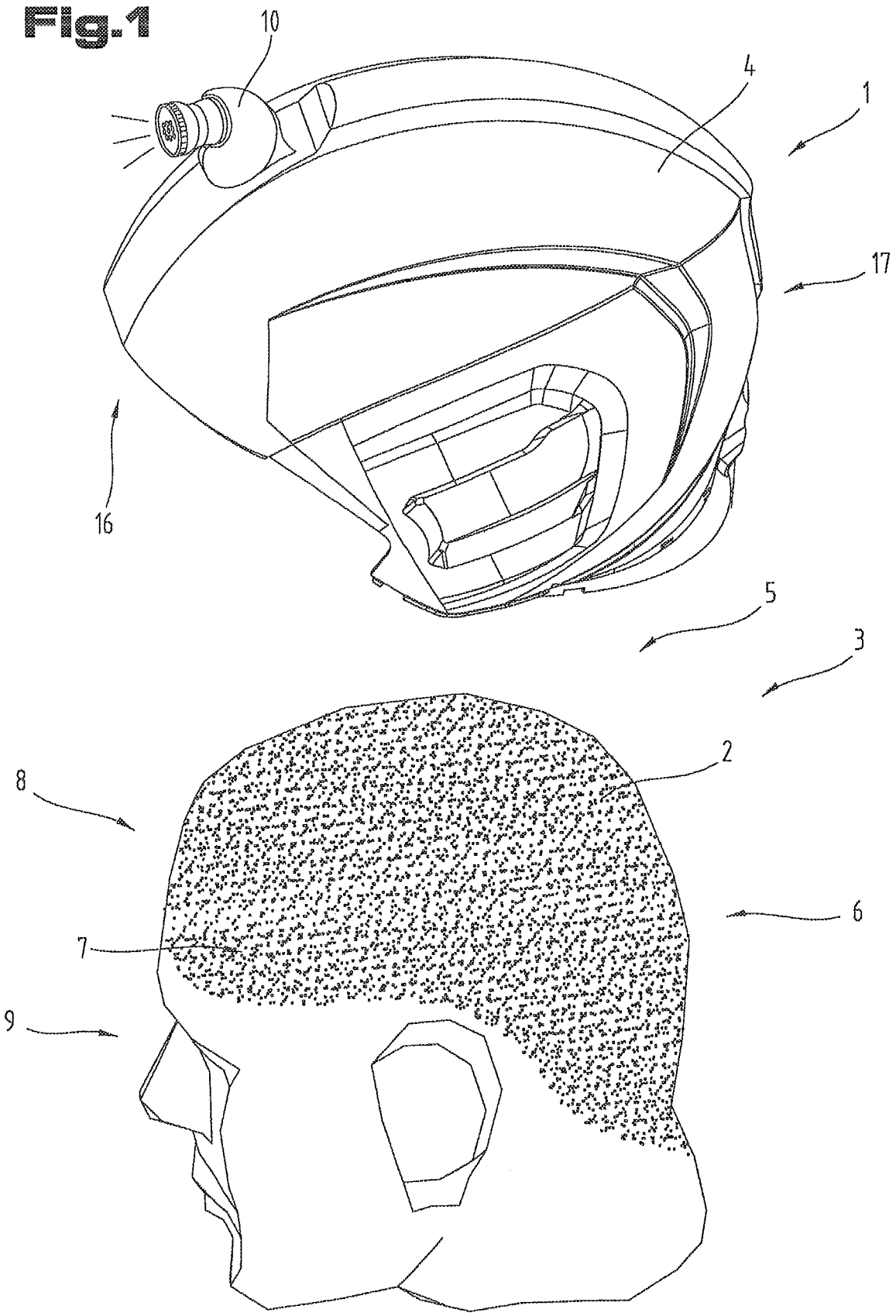
FIG. 1 shows a perspective view of a protective helmet and the head of a user.

First of all, it should be noted that in the variously described exemplary embodiments the same parts have been given the same reference numerals and the same component names, whereby the disclosures contained throughout the entire description can be applied to the same parts with the same reference numerals and same component names. Also details relating to position used in the description, such as e.g. top, bottom, side etc. relate to the currently described and represented figure and in case of a change in position should be adjusted to the new position.

FIG. 1 shows a perspective view of a protective helmet 1 which is used for protecting the head 2 of a user 3. The protective helmet 1 is designed mainly for users 3 who wear the protective helmet 1 either in difficult environments or for a longer time period, as is the case for emergency services, such as the fire department, rescue service or disaster relief services etc.

The protective helmet 1 comprises a protective shell 4, which is preferably made from a hard and unbreakable material, such as a thermoplastic material. The protective shell 4 is designed so that, when the protective helmet 1 is fitted onto the head 2 of the user 3 it covers at least the upper head area 5 of the user 3. The upper head area 5 is the area of the head 2 which is also referred to as the top of the skull. Furthermore, it is possible that the protective shell 4 is designed such that in the fitted position it also covers a rear head area 6 of the head 2. Furthermore, it is possible that the temple area 7 of the head 2 is also covered by the protective shell 4. A forehead area 8 of the user 3 is preferably partly covered, wherein the protective shell 4 is designed such that at least an eye area 9 is not covered by the protective shell 4.

Furthermore, it is possible that the protective shell 4 is designed such that additional attachments such as a head lamp 10, neck protection etc. can be mounted on the protective shell 4.

FIGS. 2 to 9 show different views of the protective helmet 1, in which the latter is shown partly in cross-section or individual components have been partly blanked out or are shown in an exploded view, in order to describe individual features of the protective helmet 1 clearly. It should be noted that in the individual FIGS. 2 to 9 the same reference numerals and component names have been used for the same parts as in the preceding figures. To avoid unnecessary repetition reference is made to the detailed description of the preceding figures. Furthermore, it should be mentioned here that for the purpose of providing a clear description of the individual features reference is made in the description to a plurality of figures which are not necessarily listed in numerical order.

Where the terms, top, bottom, left or right are used in the following description, reference is always made to an alignment of the protective helmet 1 which is placed on the head 2 of an upright standing user 3 looking horizontally forwards. The left and right side of the protective helmet 1 are hereby arranged in the same way as the left and right head half of the user 3. Such a horizontal alignment of the protective helmet 1 is shown for example in FIG. 5.

Figure 2:
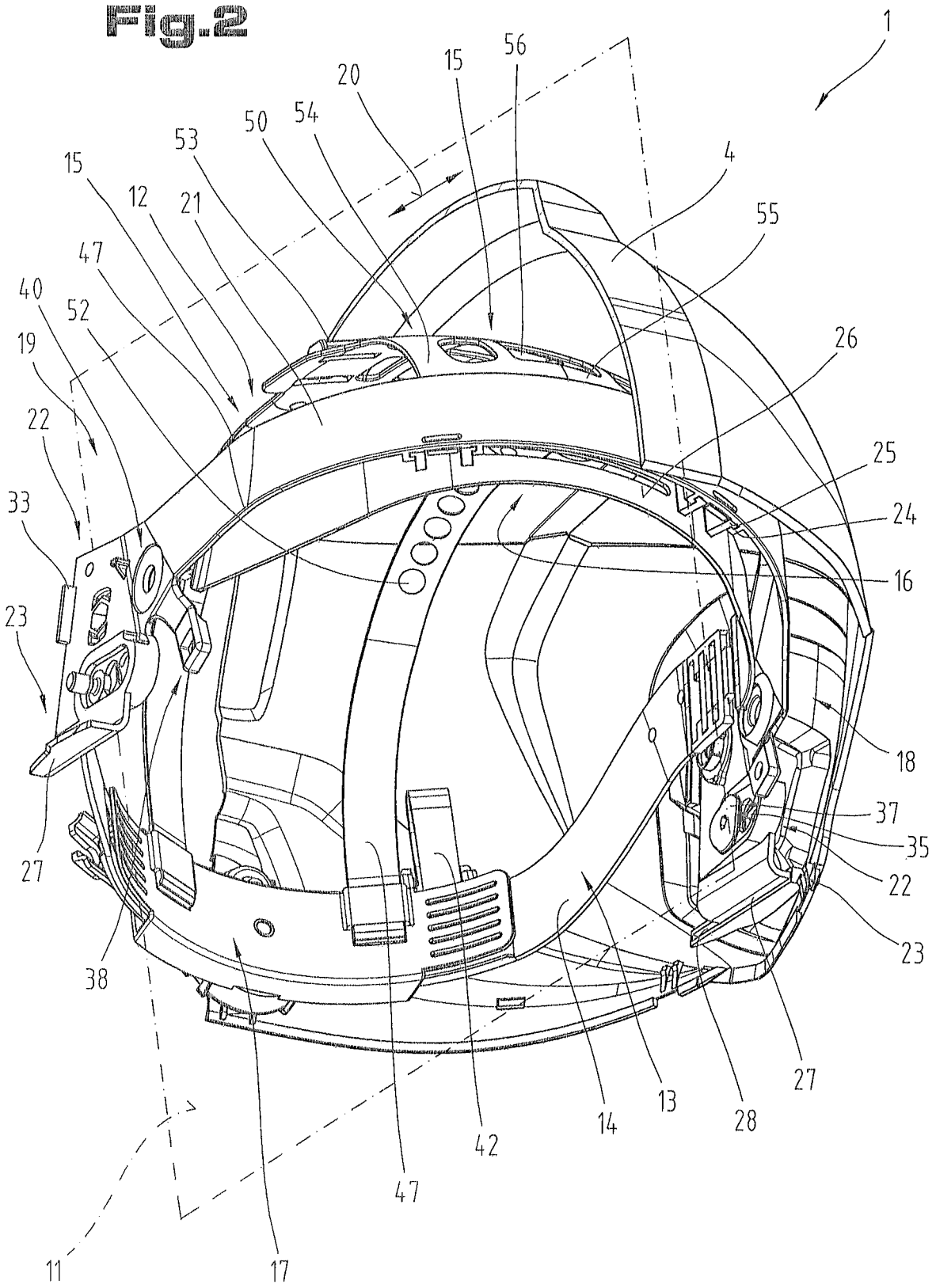
FIG. 2 shows a perspective view of the protective helmet, wherein the protective shell is shown in cross-section along a central plane of the helmet.

FIG. 2 shows a perspective view of the protective helmet 1, wherein the protective shell 4 is shown in cross-section along a helmet central plane 11, so that a support structure 12 mounted in the protective shell 4 is visible. The support structure 12 is used to mount and secure the protective shell 4 on the head 2 of a user 3.

The support structure 12 can comprise various different components which can be made from different materials. Preferably however also a large proportion of the components of the support structure 12 are made from a thermoplastic, preferably resilient plastic material.

The support structure 12 comprises a head accommodating opening 13, which is used for supporting the head 2 of the user 3, whereby the protective helmet 1 can be fitted. The head accommodating opening 13 is formed or delimited by a headband 14. By means of the headband 14 the protective helmet 1 can be secured onto the head 2 of the user 3. Furthermore, the support structure 12 comprises an upper head support 15, which adjoins the wrap-around headband 14. The upper head support 15 is used in this case for vertically fixing the protective helmet 1 on the head 2 of the user 3. In particular, the upper head support 15 is designed so that that it bears on the upper head area 5 of the head 2.

On the support structure 12 a forehead accommodating side 16 and a rear head accommodating side 17 is formed. As the name indicates the orientation of the protective helmet 1 on the head 2 of the user 3 is also described.

Furthermore, a force-transmitting connector 18 is formed, by means of which the support structure 12 is connected to the protective shell 4. According to the invention on the force-transmitting connector 18 a longitudinal adjuster 19 is formed, by means of which the protective shell 4 can be adjusted in horizontal direction relative to the support structure 12 and thus relative to the head 2 of the user 3. In particular, the protective shell 4 can be displaced in a longitudinal alignment 20 relative to the support structure 12. In this way it is possible for the protective shell 4 to be adjusted in the direction of the forehead accommodating side 16 or in the direction of the rear head accommodating side 17.

Furthermore, it is possible that a support strap 21 is formed which extends from the two temple sides 22 over the forehead accommodating side 16. In this case it is possible that the support strap 21 is connected in the region of the temples 22 respectively by a form-fitting and/or force-fitting connecting arrangement, e.g. by connector 23 to the protective shell 4. In this case the support strap 21 can be mounted displaceably in the protective shell 4 relative to the longitudinal alignment 20.

The support strap 21 is preferably made from a high strength material and preferably has suitable dimensions, so that the support strap 21 can provide a high degree of resistance to deformation from a force acting vertically on the support strap.

A movable connection between the protective shell 4 and support strap 21 can be achieved by means of a connecting arrangement, e.g. connector 23, which is described and explained in more detail below.

Furthermore, it is possible that the support structure 12 is secured to the support strap 21, so that the latter can be displaced with the support strap 21. In particular, the support strap 21 comprises on its inner side a first coupler 24 which is connected to a second coupler 25 of the support structure 12. The second coupler 25 is arranged here preferably on the outside 26 of the headband 14. A detail of the arrangement of the couplers 24, 25 is shown in particular in FIG. 9.

As shown in FIG. 2, according to an advantageous embodiment it is possible that on the outside 26 of the headband 14, in particular on the forehead accommodating side 16, two individual couplers 25 are arranged which cooperate with corresponding couplers 24 on the support strap 21. Preferably, the couplers 24, 25 are arranged to be symmetrical relative to the helmet central plane 11 so that the support structure 12 is mounted in a stable manner in the protective shell 4.

The transfer of force between the first coupler 24 and second coupler 25 can be achieved in this way by a form-fitting connection. For example, it is possible that the second coupler 25 is designed as a T-shaped projecting element on the headband 14 and that the first coupler 24 has a corresponding recess. Preferably, the recess of the first coupler 24 on the lower side of the support strap 21 is open. In this way it is possible that the second coupler 25 can be pushed from below into the first coupler 24 and thus the form-fitting connection can be produced between the two couplers 24, 25.

Furthermore, it is possible that the longitudinal adjuster 19 on the support strap 21 in the region of the two temples 22 comprises a first protrusion 27 projecting outwards in the direction of the protective shell 4, that is from the support strap 21. The first protrusion 27 projecting in the direction of the protective shell 4 preferably engages in a groove 28 arranged in the protective shell 4. In this way the support strap 21 is mounted longitudinally displaceably relative to the protective shell 4 in the latter.

Figure 3:
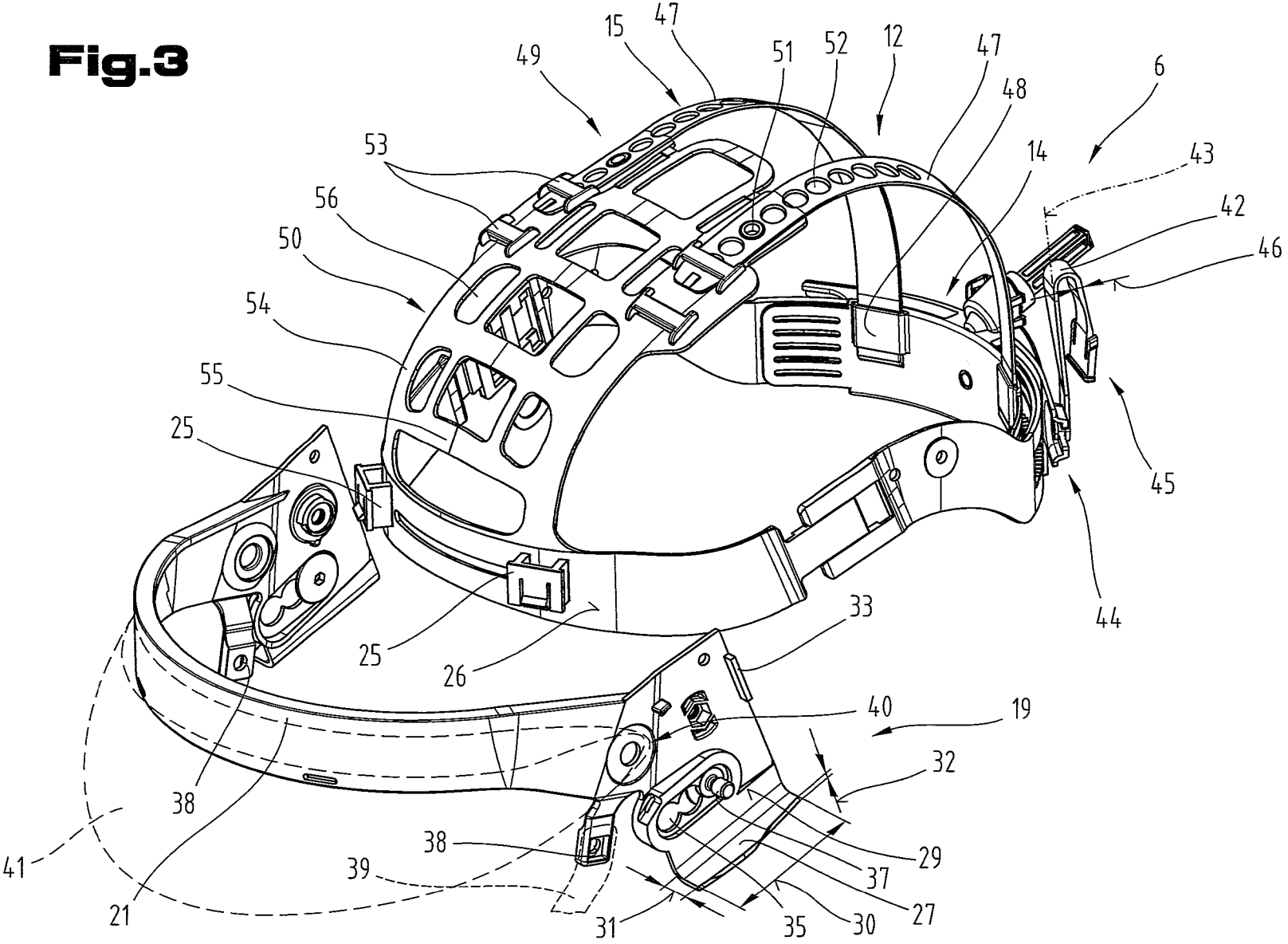
FIG. 3 shows a perspective view of a support structure and a support strap.

As shown in FIG. 3, the first protrusion 27 is preferably arranged at a right angle to a side surface 29, which is formed in the temple area 7 of the support strap 21.

The first protrusion 27 preferably has a longitudinal extension between 20 mm and 90 mm, in particular between 40 mm and 60 mm, preferably between 45 mm and 55 mm. By having a suitably selected longitudinal extension 30, it is possible that the support strap 21 can be guided effectively in the protective shell 4. In this way increased forces and also torques can be transmitted by the support strap 21 to the protective shell 4.

Furthermore, it is possible that the first protrusion 27 has a depth 31 between 3 mm and 20 mm, in particular between 5 mm and 15 mm, preferably between 8 mm and 12 mm. The depth 31 is the normal distance between the side surface 29 and an outer end wall of the first protrusion 27. The first protrusion 27 preferably has a wall thickness 32 of between 1 mm and 4 mm.

Figure 4:
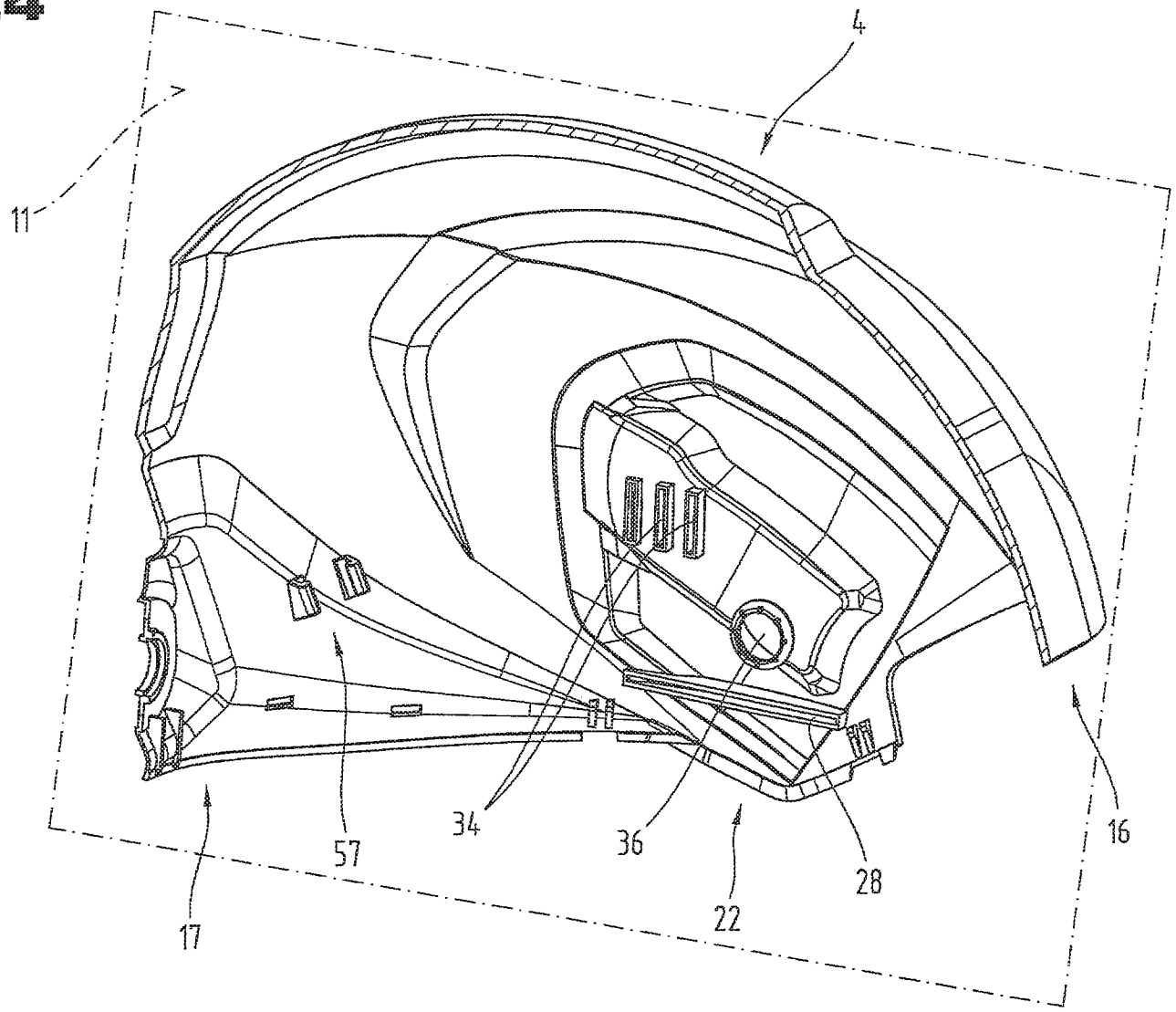
FIG. 4 shows a perspective view of a protective shell in cross-section along the central plane of the helmet.

Furthermore, it is possible to provide a second protrusion 33 on the support strap 21 in the area of both temples 22. The second protrusion 33 preferably engages in a recess 34 shown according to FIG. 4. The second protrusion 33 is preferably also arranged at a right angle to a side surface 29 and is also arranged at an angle to the first protrusion 27, so that the support strap 21 can be fixed with regard to it longitudinal displaceability relative to the protective shell 4. In particular, it is possible that the second protrusion 33 is arranged at a right angle to the first protrusion 27. Furthermore, it is possible, as shown in FIG. 4, to provide a plurality of recesses 34 in the protective shell 4, so that the support strap 21 can be locked in different positions relative to the protective shell 4.

Furthermore, it is possible that the support strap 21 in the area of both temples 22 comprises one or more openings 35, wherein in the protective shell 4 a receiving opening 36 is arranged for a fastening element 37. In this case it is possible that the fastening element 37, such as a screw, passes through the opening 35 of the support strap 21 from the inside of the support strap and is screwed into the receiving opening 36.

For securing the fastening element 37 in the receiving opening 36 it is possible that a thread is formed directly in the receiving opening 36, into which the fastening element 37 can be screwed. Alternatively to this, it is possible that in the receiving opening 36 an insert element is mounted, into which a thread is integrated. The insert element can be made from a higher strength material than the material of the protective shell 4. For example, it is possible to use a metal material for the insert element. A detailed view of the connection between the support strap 21 and protective shell 4 shown in particular in FIG. 8.

By means of the fastening element 37 the support strap 21 can be secured in the temple area 7 on the protective shell 4. By means of the protrusions 27, 33 it is possible for the support strap 21 to be fixed in a desired position relative to the protective shell 4, so that the protective shell 4 can be ideally aligned in its center of gravity relative to the support structure 12. In this way the wearing comfort of the protective helmet 1 can be increased considerably.

Furthermore, as shown in FIG. 3, it is possible that the support strap 21 comprises at least a first fastening mount 38 in the region of both temples 22 respectively, which is used for securing a chin strap 39 onto the support strap 21. The chin strap 39 is used to secure or hold the protective helmet 1 onto the head 2 of the user 3.

Furthermore, the support strap 21 in the region of both temples 22 respectively comprises at least one second fastening mount 40, onto which a pivotably protective visor 41 can be mounted. The second fastening mount 40 like the first fastening mount 38 can be designed in the form of an opening, in which the chin strap 39 or the protective visor 41 can be secured by means of a fastening element.

Furthermore, as shown in FIG. 3 it is possible that an intermediate piece 42 is formed, by means of which the support structure 12 is connected on the rear head accommodating side 17 to the protective shell 4. In this case it is possible that the intermediate piece 42 is folded back by about 180° relative to its longitudinal extension 43 of its longitudinal center, so that the band-shaped intermediate piece 42 forms a loop. By means of this structure it is possible for a first coupling section 44 to be aligned approximately parallel to a second coupling section 45. The first coupling section 44 is hereby preferably connected to the headband 14 and the second coupling section 45 to the protective shell 4. The coupling sections 44, 45 can also be formed by a T-shaped, protruding element, which engages in a corresponding groove. Of course, it is also possible for a different plug-in and form-fitting connection to be provided for the coupling sections 44, 45.

Furthermore, it is possible that two intermediate pieces 42 are arranged symmetrically relative to the helmet central plane 11 so that the support structure 12 is connected on the rear head accommodating side 17 at two securing points to the protective shell 4. If two securing points are also provided on the forehead accommodating side 16, on which the support structure 12 is connected to the support strap 21, thus the support structure 12 is connected as a whole at four securing points to the protective shell 4. In this case two points symmetrical to the helmet central plane 11 are arranged on the forehead accommodating side 16 and two points are arranged on the rear head accommodating side 17.

By means of the shown configuration and form of the intermediate piece 42 it is possible for the latter to be used as a damping element in order to absorb impact acting on the protective shell 4. The intermediate piece 42 can hereby absorb the energy applied by deformation. For this purpose it is an advantage if a wall thickness 46 of the intermediate piece 42 is selected to be between 1 mm and 4 mm, in particular about 2 mm.

By using a flexible intermediate piece 42 it is also possible for the support structure 12 to be displaceable relative to the protective shell 4, as a relative displacement and thereby a change in the distance between the rear head accommodating side 17 of the headband 14 and the protective shell 4 can be balanced out by the intermediate piece 42.

FIG. 3 shows a further and possibly independent embodiment of the protective helmet 1, wherein the same reference numerals and components names have been used for the same parts as in the preceding FIGS. 1 and 2. To avoid unnecessary repetition, reference is made to the detailed description in the preceding FIGS. 1 and 2.

As shown in FIG. 3, it is possible that the support structure 12 has two adjusting straps 47 on the upper head support 15, which extend from the rear head accommodating side 17 in the direction of the forehead accommodating side 16. In this case it is possible that the adjusting straps 47 are connected in an accommodating section 48 to the headband 14. The accommodating section 48 can be formed for example by a tab, into which an adjusting strap 47 is inserted, wherein it is possible that on the adjusting strap 47, in particular in its end section a locking projection is arranged so that the adjusting strap 47 can be mounted in a form-fitting manner in the accommodating section 48.

Furthermore, it is possible that the adjusting straps 47 are connected in a front section by a form-fitting longitudinally adjustable connection 49 to an accommodating mesh 50. The form-fitting longitudinally adjustable connection 49 can be formed for example in that on the accommodating mesh 50 a projection 51 is arranged which cooperates with one of several recesses 52 in an adjusting strap 47.

By means of the longitudinal extension of the adjusting strap 47 preferably a plurality of said recesses 52 are distributed evenly, so that the projection 51 can be moved optionally into engagement with one of said recesses 52. In this way the width of the upper head support 15 can be designed to be adjustable variably. In this way it is possible that the protective helmet 1 can be adjusted relative to its vertical position on the head 2 of the user 3 to the needs of the user 3.

Furthermore, it is possible that at least one holding-down element 53 per adjusting strap 47 is arranged on the accommodating mesh 50 so that the adjusting strap 47 can be positioned and guided relative to the accommodating mesh 50. The holding-down element 53 is hereby designed preferably as a U-shaped tab, the end sections of which are connected to the accommodating mesh 50 and thereby form an opening. The cross-section or the internal width of this opening is preferably slightly larger than the cross-section of the adjusting strap 47, so that the adjusting strap 47 can be guided almost without play in the holding-down element 53.

Furthermore, it is possible that the accommodating mesh 50 comprises strap sections 54 aligned in longitudinal direction and strap sections 55 aligned in transverse direction. Said strap sections can form a net-like structure, wherein between the strap sections 54, 55 recesses 56 can be formed. By means of this structure it is possible that the accommodating mesh 50 on the one hand is as light and air-permeable as possible and on the other hand has the greatest possible bearing surface so that a force possibly acting on the protective helmet 1 can be distributed as effectively as possible on the upper head area 5.

FIG. 3 also shows clearly the arrangement of the two couplers 25 on the headband 14 of the support structure 12.

FIG. 4 shows a perspective view of a protective shell 4 which is shown in cross-section relative to the helmet central plane 11. In this representation it can be seen that the groove 28, the recess 34 and the receiving opening 36 can be formed at a temple 22 of the protective shell 4.

Said elements formed in the protective shell 4 are preferably formed to be opposite the respective projections on the support strap 21 so that the support strap 21 can be connected in the described manner to the protective shell 4. Furthermore, FIG. 4 shows clearly that on the protective shell 4 a coupling accommodation 57 can be formed in which the second coupling section 45 of the intermediate piece 42 can be mounted.

Figure 5:
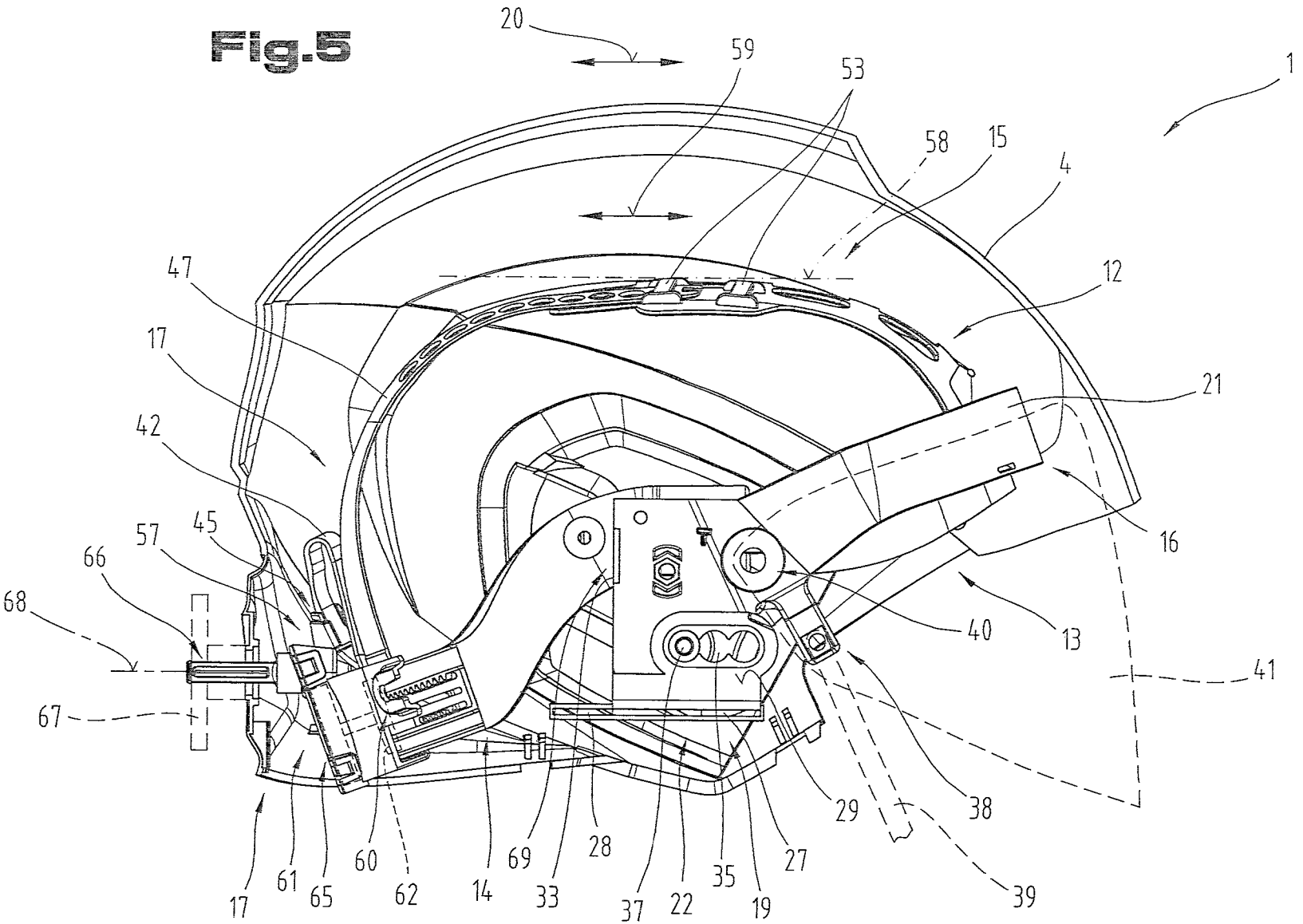
FIG. 5 shows a side view of a protective helmet with a protective shell in cross-section along the central plane of the helmet.

FIG. 5 shows a side view of the protective helmet 1, wherein the protective shell 4 is shown in cross-section relative to the helmet central plane 11. In this representation the protective helmet 1 is aligned as if it were placed on the head 2 of the user 3, wherein the head 2 of a standing user 3 is aligned to be horizontal. There is thus a horizontal alignment of the protective helmet 1. In particular, in the position of the protective helmet 1 shown according to FIG. 5 an upper head support plane 58, formed by the upper head support 15, is aligned to be approximately horizontal.

Furthermore, FIG. 5 shows that the groove 28, into which the support strap 21 engages, and the corresponding first protrusion 27, are arranged to be approximately parallel to the upper head support plane 58. In this way the protective shell 4 can be displaced in an also horizontally aligned longitudinal adjusting direction 59 relative to the support structure 12.

Furthermore, FIG. 5 shows that the intermediate piece 42, in particular its second coupling section 45, is mounted in the coupling accommodation 57 of the protective shell 4. Furthermore, a further coupling accommodation 60 is shown, which is formed on the support structure 12, in particular on the rear head area 6 of the headband 14 and in which the first coupling section 44 of the intermediate piece 42 can be mounted.

Furthermore, as shown in FIG. 5, it is possible that on the rear head accommodating side 17 of the headband 14 a width adjuster 61 is formed, by means of which the circumference of the headband 14 can be adjusted to the head circumference of a user 3. The functionality of the width adjuster 61 is described in more detail and explained with reference to an overview of FIG. 5 and FIG. 6.

Figure 6:
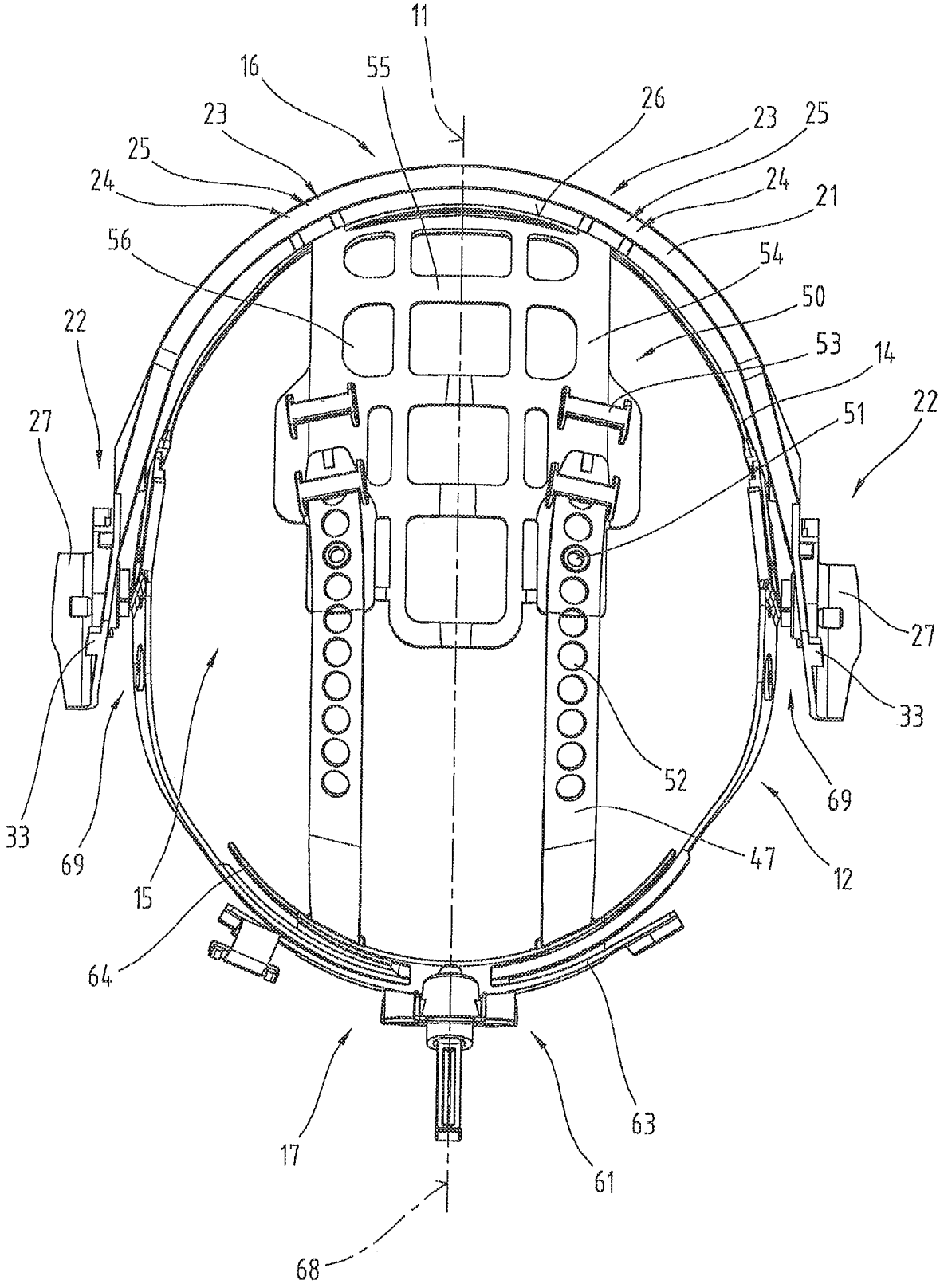
FIG. 6 shows a plan view of a support structure and a support strap connected to the latter.

As shown in an overview of FIG. 5 and FIG. 6, it is possible that the width adjuster 61 comprises a gear wheel 62, which engages in a first end section 63 and a second end section 64 of the headband 14, wherein the two end sections 63, 64 overlap one another. In particular, it is possible that the two end sections 63, 64 comprise a recess, wherein in one of the two end sections 63, 64 for example in the first end section 63 in an upper area a toothing is formed on the other respective end section in a lower part of the recess a toothing is formed. These two toothings are in engagement respectively with the gear wheel 62. Thus it is possible that with the rotation of the gear wheel 62 in a first direction the headband 14 is adjusted to be narrower, as the two end sections 63, 64 are displaced in a first direction relative to one another and with a rotation of the gear wheel 62 in the second direction the headband 14 is further adjusted, as both end sections 63, 64 are displaced in a second direction relative to one another.

Furthermore, it is possible that the width adjuster 61 comprises a gear 65, which is connected between a drive shaft 66 and the gear wheel 62. Alternatively, it is possible that the gear wheel 62 is attached directly onto the drive shaft 66.

The drive shaft 66 is preferably guided outwards by the protective shell 4 so that it is accessible from the outside. Furthermore, it is possible that an adjusting wheel is movably coupled to the drive shaft 66, so that by means of a rotation of the adjusting wheel 67 the drive shaft 66 and thus the gear wheel 62 can be rotated. In this way it is possible for the drive shaft 66 to have a polygonal circumferential structure, in particular a rectangular cross-section, so that the adjusting wheel 67 and the drive shaft 66 engage with one another in a form-fitting manner. It is thus possible for the adjusting wheel 67 to be displaced relative to the drive shaft 66 in its longitudinal axis 68, wherein there can be a transfer of torque between the adjusting wheel 67 and drive shaft 66 in each position of the adjusting wheel 67 relative to the drive shaft 66. In this way it is possible that with an adjustment movement of the support structure 12 relative to the protective shell 4, the drive shaft 66 can be displaced relative to the adjusting wheel 67 and can thereby be adjusted in each position of the support structure 12 of the width adjuster 61 by means of the adjusting wheel 67.

It is also shown in FIG. 6 that the support strap 21 extends in a semi-circular arc from one temple 22 to the other temple 22. Furthermore, the arrangement of the first protrusion 27 on both temples 22 is shown.

In order to join the support strap 21 to the protective shell 4 or in order to remove the latter from the protective shell 4 again, it is possible that the support strap 21 is loaded on both temples 22 by a force aligned in the direction of a helmet central plane 11, so that the support strap 21 is pushed together and thereby deforms elastically. In this way it is possible that the first protrusion 27 can be moved into engagement with the groove 28 or optionally disengaged therefrom.

FIG. 6 also shows clearly that the support structure 12 and the support strap 21 are designed to be symmetrical relative to the helmet central plane 11, and in the forehead area 8 on both sides of the helmet central plane 11 respectively the first coupler 24 and the second coupler 25 are arranged, by means of which the support structure 12 is connected to the support strap 21.

As shown in FIGS. 5 and 6, it is also possible that on the headband 14 a rough adjuster 69 is formed, by means of which in addition to the width adjuster 61 a circumferential adjustment of the headband 14 can be achieved. Preferably, the rough adjuster 69 is also formed on both temples 22, so that the headband 14 can be adjusted symmetrically to the helmet central plane 11.

Figure 7:
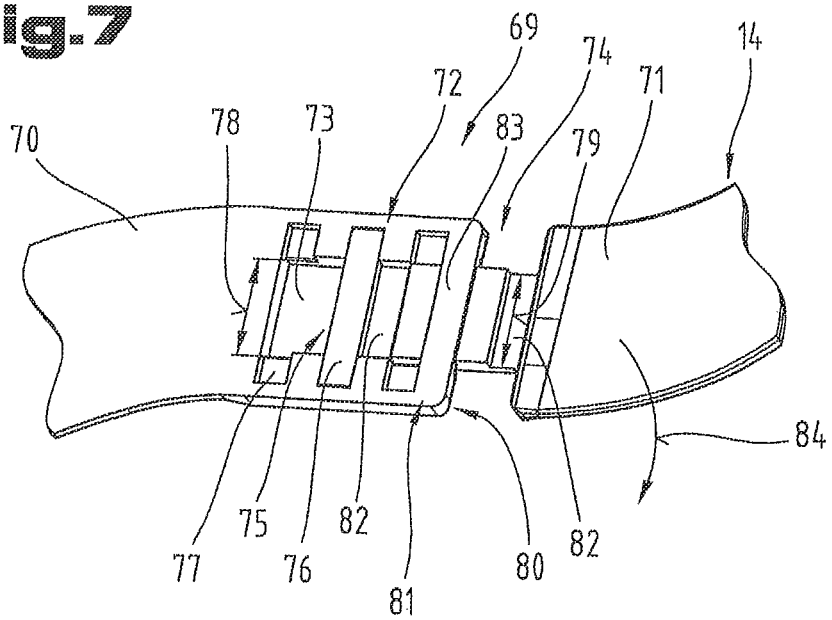
FIG. 7 shows a perspective detailed view of a rough adjuster on a headband.

FIG. 7 shows a perspective view of the rough adjuster 69. As shown in FIG. 7, it is possible that the rough adjuster 69 comprises a first headband area 70 and a second headband area 71, which face one another and are joined together by a form-fitting locking element 72. The locking element 72 can be formed in that in the first headband area 70 an opening 73 is provided and in the second headband area 71 a tapering 74 is provided, which is guided through the opening 73 of the first headband area 70. In this case it is possible that in an end section 75 of the tapering 74 a projection 76 is arranged, which can be moved into engagement with one of several recesses 77 in the first headband area 70. The recesses 77 are arranged above and below the opening 73, so that they project over a width 78 of the opening 73. The projections 76 are thus also designed such that they project above and below the tapering 74 over the width 79 of the tapering 74. The tapering 74 is hereby guided from a rear side 80 through the opening 73, wherein on a front side 81 the recesses 77 are arranged and thus the projection 76 engages in the latter.

In addition to this, it is possible that on the tapering 74 recesses 82 are formed which can be moved into engagement with a protrusion 83 of the first headband area 70.

The headband width can be adjusted by the rough adjuster 69 in that the second headband area 71 is pivoted to the rear in a pivot moving direction 84, whereby both the projection 76 in the recess 77 and the recess 82 in the protrusion 83 are disengaged. Afterwards the two headband areas 70, 71 can be moved closer to one another or are spaced further apart from one another. After completing this adjustment the second headband area 71 can be pivoted opposite the pivot moving direction 84 back into the position shown in FIG. 7, whereby the form-fitting connection of the first headband area 70 is formed by the second headband area 71.

Figure 8:
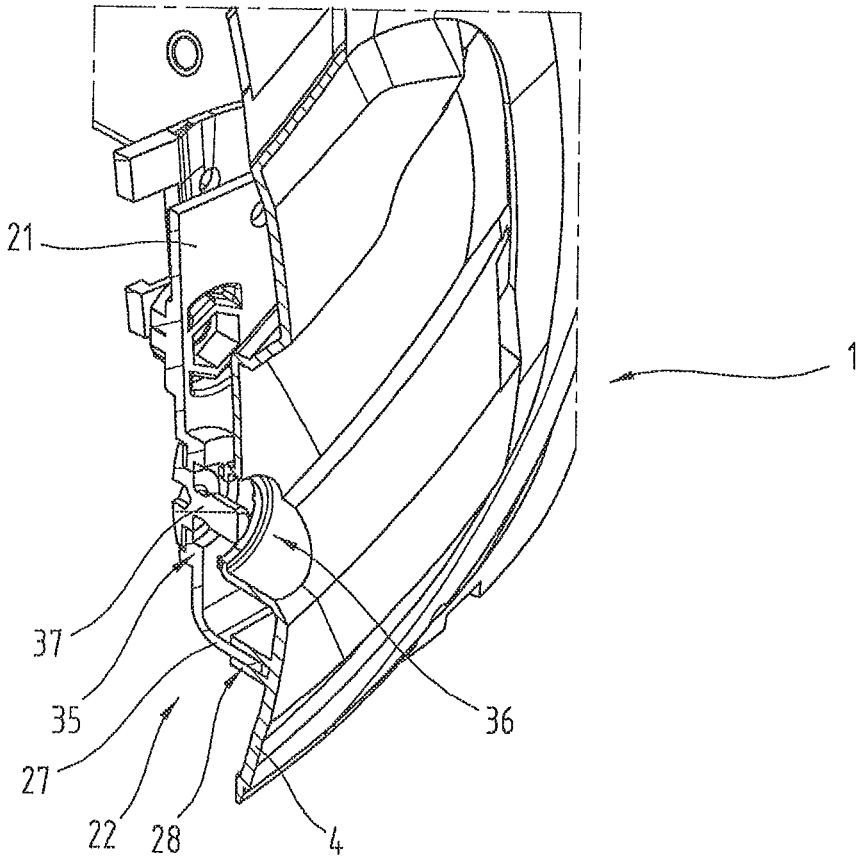
FIG. 8 shows a perspective cross-sectional view of a protective helmet.

FIG. 8 shows a further perspective view of a protective helmet 1, wherein the latter is shown in cross-section at the temples 22 in the region of the opening 35 and receiving opening 36.

As shown in detail in FIG. 8, the fastening element 37 is guided through the opening 35 in the support strap 21 and is introduced into a receiving opening 36 of the protective shell 4 and by means of a not shown mounting element, such as a nut or a thread, is secured in the receiving opening 36.

Furthermore, FIG. 8 shows the connection between the first protrusion 27 and groove 28.

Figure 9:
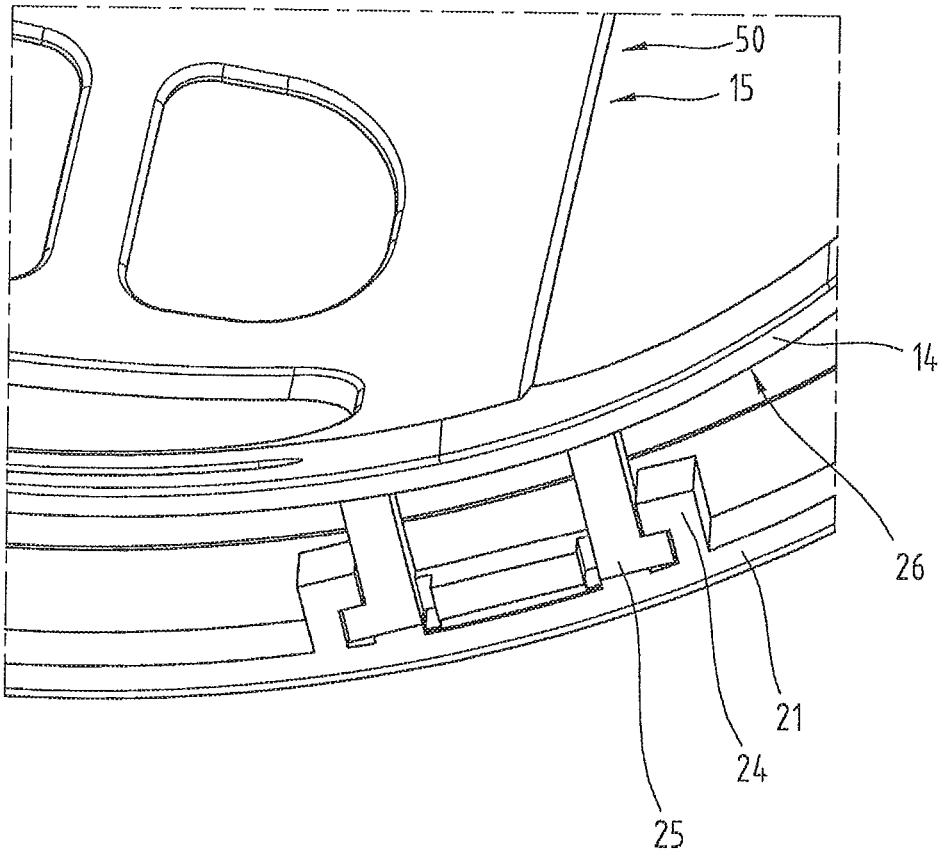
FIG. 9 shows a detailed view of a connection between the protective shell and support structure.

FIG. 9 shows a perspective view of the connector 23. Here it is shown clearly that the first coupler 24 is formed in the support strap 21 and the second coupler 25 is arranged on the outside 26 of the headband 14, wherein the two couplers 24, 25 engage with one another in a form-fitting manner.

By combining the individual adjusters described in detail in this document it is possible for the protective helmet 1 to be adjusted as variably as possible to the different head sizes of different users 3, so that the protective helmet 1 is fitted as comfortably as possible on the head 2 of the user 3. In this way the safety can be improved from both points of view.

On the one hand, upon the occurrence of a possible force the protective helmet 1 can protect the user 3 as effectively as possible from injury. On the other hand by means of the high level of wearing comfort of the protective helmet 1 safety can be improved to the extent that the user's 3 concentration is not disturbed by wearing the protective helmet 1 and he can thus carry out the job or steps required.

The exemplary embodiments show possible embodiment variants of the protective helmet 1, whereby it should be noted at this point that the invention is not restricted to the embodiment variants shown in particular, but rather various different combinations of the individual embodiment variants are also possible and this variability, due to the teaching on technical procedure, lies within the ability of a person skilled in the art in this technical field.

Furthermore, also individual features or combinations of features from the shown and described different example embodiments can themselves represent independent solutions according to the invention.

The underlying objective of the independent solutions according to the invention can be taken from the description.

All of the details relating to value ranges in the present description are defined such that the latter include any and all part ranges, e.g. a range of 1 to 10 means that all part ranges, starting from the lower limit of 1 to the upper limit 10 are included, i.e. the whole part range beginning with a lower limit of 1 or above and ending at an upper limit of 10 or less, e.g. 1 to 1.7, or 3.2 to 8.1 or 5.5 to 10.

Mainly the individual embodiments shown in FIGS. 1, 2, 3, 4, 5, 6, 7, 8, 9 can form the subject matter of independent solutions according to the invention. The objectives and solutions according to the invention relating thereto can be taken from the detailed descriptions of these figures.

In particular, the configuration of the upper head support 15 of the support structure 12, such as the adjusting straps 47, which are connected in a longitudinal adjusting manner to an accommodating mesh 50 and additional specific features of the configuration of the upper head support 15 can form the subject matter of independent solutions according to the invention.

Furthermore, also the configuration of the headband 14, such as its width adjuster 61 or the rough adjuster 69 can form the subject matter of the independent solutions according to the invention.

Finally, as a point of formality, it should be noted that for a better understanding of the structure of the protective helmet, the latter and its components have not been represented true to scale in part and/or have been enlarged and/or reduced in size.

List of reference numerals

| | |
|---|---|
| 1 | protective helmet |
| 2 | head |
| 3 | user |

-continued

| List of reference numerals | |
|---|---|
| 4 | protective shell |
| 5 | upper head area |
| 6 | rear head area |
| 7 | temple area |
| 8 | forehead area |
| 9 | eye area |
| 10 | head lamp |
| 11 | helmet central plane |
| 12 | support structure |
| 13 | head accommodating opening |
| 14 | headband |
| 15 | upper head support |
| 16 | forehead accommodating side |
| 17 | rear head accommodating side |
| 18 | connector |
| 19 | longitudinal adjuster |
| 20 | longitudinal alignment |
| 21 | support strap |
| 22 | temple |
| 23 | connecting arrangement |
| 24 | first coupler |
| 25 | second coupler |
| 26 | outside of the forehead |
| 27 | first protrusion |
| 28 | groove |
| 29 | side surface |
| 30 | longitudinal extension |
| 31 | depth |
| 32 | wall thickness |
| 33 | second protrusion |
| 34 | recess |
| 35 | opening |
| 36 | receiving opening |
| 37 | fastening element |
| 38 | first fastening mount |
| 39 | chin strap |
| 40 | second fastening mount |
| 41 | protective visor |
| 42 | intermediate piece |
| 43 | longitudinal extension |
| 44 | first coupling section |
| 45 | second coupling section |
| 46 | wall thickness intermediate piece |
| 47 | adjusting strap |
| 48 | accommodating section |
| 49 | form-fitting connection longitudinally adjustable connection |
| 50 | accommodating mesh |
| 51 | projection |
| 52 | recess |
| 53 | holding-down element |
| 54 | longitudinally aligned strap section |
| 55 | transversely aligned strap section |
| 56 | recess |
| 57 | coupling accommodation |
| 58 | upper head support plane |
| 59 | longitudinal adjusting direction |
| 60 | further coupling accommodation |
| 61 | width adjuster |
| 62 | gear wheel |
| 63 | first end section |
| 64 | second end section |
| 65 | gear |
| 66 | drive shaft |
| 67 | adjusting wheel |
| 68 | longitudinal axis |
| 69 | rough adjuster |
| 70 | first headband area |
| 71 | second headband area |
| 72 | locking element |
| 73 | opening |
| 74 | tapering |
| 75 | end section |
| 76 | projection |
| 77 | recess |
| 78 | width opening |
| 79 | width tapering |
| 80 | rear side |

-continued

| List of reference numerals | |
|---|---|
| 81 | front side |
| 82 | recess |
| 83 | protrusion |
| 84 | pivot moving direction |

The invention claimed is:

1. A protective helmet for a head of a human being, the protective helmet comprising an outer protective shell, and an inner support structure, which support structure comprises a headband and an upper head support defining a head accommodating opening, and the support structure comprises on the headband a forehead accommodating side and a side adapted to accommodate a back of the head, wherein the support structure is secured onto the protective shell by at least one connector, wherein between the protective shell and the support structure a longitudinal adjuster is arranged, by which longitudinal adjuster the inner support structure is adjustable relative to the protective shell in a direction of the forehead accommodating side or in another direction of the side adapted to accommodate the back of the head, wherein the longitudinal adjuster comprises a support strap, which support strap is adapted to extend from both temples over the forehead accommodating side, wherein the longitudinal adjuster is adapted to be connected to the protective shell in regions of both temples, wherein the support strap comprises at least one first coupler interacting with at least one second coupler on the support structure, and wherein the longitudinal adjuster further comprises at least one first protrusion aligned parallel to an upper head support plane extending longitudinally and projecting in a direction of the protective shell, the at least one first protrusion engaging in a groove arranged in the protective shell, whereby the longitudinal adjuster is mounted to be longitudinally displaceable relative to the protective shell.

2. The protective helmet as claimed in claim 1, wherein the at least one first coupler is two first couplers arranged on the support strap in a region of the forehead accommodating side symmetrically relative to a helmet central plane, and wherein the at least one second coupler is two second couplers arranged on the support structure and interacting with the two first couplers.

3. The protective helmet as claimed in claim 1, wherein the longitudinal adjuster further comprises at least one second protrusion arranged at an angle to the at least one first protrusion and projecting in the direction of the protective shell, and wherein the at least one second protrusion engages in one or several recesses arranged on the protective shell.

4. The protective helmet as claimed in claim 1, wherein the longitudinal adjuster further comprises at least one opening, wherein in the protective shell a receiving opening is arranged, and wherein a fastening element passes through the at least one opening and is mounted in the receiving opening.

5. The protective helmet as claimed in claim 1, wherein the support strap comprises at least one first fastening mount, and wherein the at least one first fastening mount is used for securing a chin strap.

6. The protective helmet as claimed in claim 5, wherein the support strap further comprises at least a second fastening mount for a pivotable protective visor.

7. The protective helmet as claimed in claim 1, wherein on the upper head support of the support structure symmetrically relative to a helmet central plane at least two adjusting straps are arranged running from the side adapted to accommodate the back of the head in the direction of the forehead accommodating side, and wherein the at least two adjusting straps are connected to be longitudinally adjustable by a longitudinally adjustable connection to an accommodating mesh arranged on the forehead accommodating side.

8. The protective helmet as claimed in claim 1, wherein the headband of the support structure further comprises on the side adapted to accommodate the back of the head a width adjuster to be adjustable in circumference, whereby the head accommodating opening can be varied in size.

9. The protective helmet as claimed in claim 8, wherein the width adjuster comprises a gear wheel, which engages in two overlapping end sections of the headband, wherein the gear wheel is articulated by a gear via a drive shaft, on which drive shaft an adjusting wheel engages, wherein the drive shaft has a polygonal cross-section, so that the adjusting wheel is displaceable relative to the drive shaft in a longitudinal axis direction of the drive shaft.

10. The protective helmet as claimed in claim 8, wherein the headband comprises in addition to the width adjuster at least one rough adjuster.

11. The protective helmet as claimed in claim 10, wherein the headband comprises in a region of the at least one rough adjuster a first headband area and a second headband area, which face one another and are connected together by a form-fitting locking element.

12. The protective helmet as claimed in claim 11, wherein the first headband area includes an opening and the second headband area includes a tapered end, wherein the tapered end of the second forehead strip area is received in the opening of the first headband area, and wherein the form-fitting locking element comprises recesses in the first headband area and projections in the second headband area, the recesses interacting with the projections.

13. The protective helmet as claimed in claim 1, wherein the headband is connected to the protective shell on the side adapted to accommodate the back of the head at least by an intermediate piece.

14. A protective helmet for a head of a human being, the protective helmet comprising an outer protective shell and an inner support structure, which support structure comprises a headband and an upper head support defining a head accommodating opening, and the support structure comprises on the headband a forehead accommodating side and a side adapted to accommodate a back of the head, wherein the support structure is secured onto the protective shell by at least one connector, wherein between the protective shell and the support structure a longitudinal adjuster is arranged, by which longitudinal adjuster the support structure is adjustable relative to the protective shell in a direction of the forehead accommodating side or in a another direction of the side adapted to accommodate the back of the head, wherein the longitudinal adjuster comprises a support strap, which support strap is adapted to extend from both temples over the forehead accommodating side, wherein the longitudinal adjuster is adapted to be connected to the protective shell in regions of both temples, wherein the support strap comprises at least one first coupler interacting with at least one second coupler on the support structure, wherein the support structure comprises a first adjusting strap and a second adjusting strap, wherein the first and the second adjusting straps are arranged on the upper head support of the support structure symmetrically relative to a helmet central plane and run from the side adapted to accommodate the back of the head in the direction of the forehead accommodating side, and wherein the first and the second adjusting straps are connected to be longitudinally adjustable by a longitudinally adjustable connection to an accommodating mesh arranged on the forehead accommodating side.

15. The protective helmet as claimed in claim 14, wherein the longitudinally adjustable connection further comprises a projection of the accommodating mesh engaging in a one of several recesses arranged on the first and the second adjusting straps.

16. The protective helmet as claimed in claim 14, wherein the accommodating mesh comprises first strap sections aligned in a longitudinal direction and second strap sections aligned in a transverse direction, such that the first strap sections and second strap sections form a net.

17. The protective helmet as claimed in claim 14, wherein on the accommodating mesh at least one holder is formed, by which at least one of the first and the second adjusting straps is guided.

18. A protective helmet for a head of a human being, the protective helmet comprising an outer protective shell and an inner support structure, which support structure comprises a headband and an upper head support defining a head accommodating opening, and the support structure comprises on the headband a forehead accommodating side and a side adapted to accommodate a back of the head, wherein the support structure is secured onto the protective shell by at least one connector, wherein between the protective shell and the support structure a longitudinal adjuster is arranged, by which longitudinal adjuster the support structure is adjustable relative to the protective shell in a direction of the forehead accommodating side or in a another direction of the side adapted to accommodate the back of the head, wherein the longitudinal adjuster comprises a support strap, which support strap is adapted to extend from both temples over the forehead accommodating side, wherein the longitudinal adjuster is adapted to be connected to the protective shell in regions of both temples, wherein the support strap comprises at least one first coupler interacting with at least one second coupler on the support structure, and wherein the headband is connected to the protective shell on the side adapted to accommodate the back of the head at least by an intermediate piece.

19. The protective helmet as claimed in claim 18, wherein the intermediate piece is designed as a strap, which is folded back relative to a longitudinal extension, so that a first coupling section and a second coupling section of the strap are aligned to be approximately parallel to one another, wherein the first coupling section is connected to the headband and wherein the second coupling section is connected to the protective shell.

20. A protective helmet for a head of a human being, the protective helmet comprising an outer protective shell and an inner support structure, which support structure comprises a headband and an upper head support defining a head accommodating opening, and the support structure comprises on the headband a forehead accommodating side and a side adapted to accommodate a back of the head, wherein the support structure is secured onto the protective shell by at least one connector, wherein between the protective shell and the support structure a longitudinal adjuster is arranged, by which longitudinal adjuster the support structure is adjustable relative to the protective shell in a direction of the forehead accommodating side or in another direction of the side adapted to accommodate the back of the head, wherein the longitudinal adjuster comprises a support strap, which support strap is adapted to extend from both temples over the forehead accommodating side, wherein the longitudinal adjuster is adapted to be connected to the protective shell in regions of both temples, wherein the support strap comprises at least one first coupler interacting with at least one second coupler on the support structure, wherein the headband of the support structure further comprises on the side adapted to accommodate the back of the head a width adjuster to be adjustable in circumference, whereby the head accommodating opening can be varied in size, wherein the width adjuster comprises a gear wheel, which engages in two overlapping end sections of the headband, wherein the gear wheel is articulated by a gear via a drive shaft, on which drive shaft an adjusting wheel engages, wherein the drive shaft has a polygonal cross-section, so that the adjusting wheel is displaceable relative to the drive shaft in a longitudinal axis direction of the drive shaft, wherein the headband comprises in addition to the width adjuster at least one rough adjuster, wherein the headband comprises in a region of the at least one rough adjuster a first headband area and a second headband area, which face one another and are connected together by a form-fitting locking element, wherein the first headband area includes an opening and the second headband area includes a tapered end, wherein the tapered end of the second headband area is received in the opening of the first headband area, and wherein the form-fitting locking element comprises recesses in the first headband area and projections in the second headband area, the recesses interacting with the projections.

* * * * *